US006450100B1

(12) United States Patent
Carson

(10) Patent No.: US 6,450,100 B1
(45) Date of Patent: Sep. 17, 2002

(54) METHOD FOR MAKING AN IMPROVED PAINTBALL GRENADE

(75) Inventor: Anthony R. Carson, Waynoka, OK (US)

(73) Assignee: ACAR, L.L.C., Enid, OK (US)

( * ) Notice: Subject to any disclaimer, the term of this patent is extended or adjusted under 35 U.S.C. 154(b) by 0 days.

(21) Appl. No.: 09/665,623

(22) Filed: Sep. 19, 2000

Related U.S. Application Data

(60) Provisional application No. 60/184,593, filed on Feb. 24, 2000.

(51) Int. Cl.[7] ..... F42B 12/40

(52) U.S. Cl. ..... 102/513; 446/267; 446/473; 473/594

(58) Field of Search ..... 102/498, 502, 102/513; 273/428; 473/593, 594, 577, 609, 611; 446/267, 473

(56) References Cited

U.S. PATENT DOCUMENTS

| | | | | | |
|---|---|---|---|---|---|
| 3,878,639 | A | * | 4/1975 | Scheelar et al. | 46/1 R |
| 4,240,396 | A | * | 12/1980 | Randoll | 124/17 |
| 4,684,137 | A | * | 8/1987 | Armer, Jr. et al. | 273/428 |
| 4,932,672 | A | | 6/1990 | Tippmann | |
| 4,944,521 | A | * | 7/1990 | Greeno | 273/428 |
| 5,018,449 | A | * | 5/1991 | Eidson, II | 102/498 |
| 5,240,450 | A | * | 8/1993 | Graham | 446/267 |
| 5,393,054 | A | * | 2/1995 | Rouffer | 273/58 H |
| 5,887,577 | A | * | 3/1999 | Sherrill | 124/20.1 |
| 6,210,709 | B1 | * | 4/2001 | Laba et al. | 424/451 |

FOREIGN PATENT DOCUMENTS

| | | | | |
|---|---|---|---|---|
| CA | 2099035 | * | 9/1992 | F42B/008/26 |

OTHER PUBLICATIONS

Tippman's Squadbuster Paint Grenade Advertised on PaintballGear.com at http://store.yahoo.com/actionvillage/Squadpaingre.html.

From www.warpig.com/paintball/newbie/aboutpb.shtml titled All About Paintball which was a reprint of an article written by Jessica J. Sparks for Action Pursuit Games Magazine, Dec. 1996.

From www.extremesportsworld.com/paintball.htm titled History of Paint Ball.

From www.warpig.com/paintball/newbie/rspfaq.shtml titled Rec.Sport.Paintball —FAQ and Guidelines for Posting, Original FAQ by Steve Mitchell.

From www.paintmagazine.com/wpaint1/jim.shtml, an article by Mike Wallis titled In the Beginning.

Blaster Water Ballon Launcher advertised on www.b2sj.com/blaster/product.htm.

* cited by examiner

*Primary Examiner*—Charles T. Jordan
*Assistant Examiner*—Gabriel S Sukman
(74) *Attorney, Agent, or Firm*—Thompson & Knight LLP; Richard L. Wynne, Jr.; Robert C. Hilton

(57) ABSTRACT

A method for making a paintball grenade includes adding a thickening agent, a coloring agent, and a mixing agent to an enclosure, such as a balloon. Water is added to the enclosure and combines with the thickening agent and the coloring agent to form a colored, gelatinous liquid. The mixing agent facilitates the mixing of the thickening agent and the coloring agent with the water. The enclosure can be thrown or launched during a game of paintball to eliminate players on an opposing team from the game.

12 Claims, 2 Drawing Sheets

METHOD FOR MAKING AN IMPROVED PAINTBALL GRENADE

This application claims the benefit of U.S. Provisional Application No. 60/184,593, filed Feb. 24, 2000.

BACKGROUND OF THE INVENTION

1. Field of the Invention

This invention relates in general to a paintball apparatus and in particular to an improved paintball grenade for use in mock-war games and to a method for making such grenades.

2. Description of Related Art

The game of paintball, by many accounts, was created in the late 1970's or early 1980's by veterans of the Vietnam War. The veterans attempted to create a game involving the element of stalking and being stalked. The first paintball game was played in 1981 in New Hampshire in a "capture-the-flag" format. In capture-the-flag, two teams are organized, each team having a flag located at the team base. The object of the game is for a player to take, or capture, the flag of the other team while protecting his own flag. While attempting to capture the opponent's flag, a player tries to eliminate players on the opposing team by tagging them with a paintball. The paintball is typically fired from a specialized airgun called a "paintgun."

The primary equipment associated with the game of paintball includes paintguns and paintballs. Paintguns, which are often called "markers," are generally compressed air guns that will propel a paintball from the barrel of the marker at speeds up to 300 feet per second. Some markers require each paintball to be manually fed, while other markers have semi-automatic or fully automatic loading features. Paintballs are round gelatin capsules containing colored liquid inside the capsule. Traditional paintballs have diameters of approximately 0.7 inches. The liquid inside the paintball is generally non-toxic, water soluble, and biodegradable. The gelatin capsule is thin enough that it will burst when it strikes the flesh of a human being, but thick enough to contain the liquid when subjected to the forces of firing the paintball from a marker.

As the sport of paintball has developed over the last several years, so have the equipment and accessories associated with the sport. Camouflage clothing is often worn by players to allow them to blend into their surroundings and hide from opposing team members. Full coverage face masks are worn to protect not only the players' eyes, but also other sensitive areas of the face. Sophisticated reloading equipment is used by some players to quickly reload their markers when the paintball magazine for a maker has been emptied. Finally, advanced utility belts and harnesses are sometimes worn by players to carry their equipment during combat.

One recent development in paintball technology is the paintball grenade. The paintball grenade is much larger than a single paintball and is usually thrown at an opponent. Because of its larger size, the grenade is designed to record a "kill" even if the opposing team member is not directly hit with the grenade. The grenade also allows a player to eliminate several members of an opposing team with one grenade. For example, a grenade impacting the ground or a tree in proximity to the intended target will rupture, causing the paint inside the grenade to be sprayed out in a pattern from the point of impact. If the intended target or targets are within that field of spray, they will be hit with the paint, resulting in a recorded kill for the opposing team.

The few paintball grenades that have been introduced into the market are constructed in the same manner as traditional paintballs. Namely, they consist of a gelatin shell surrounding a colored gel. These grenades, however, are extremely expensive, often having a retail price more than 300 times that of a traditional paintball. Accordingly, the grenades have not gained widespread popularity.

A need exists, therefore, for a paintball grenade that is easily and inexpensively manufactured. A need also exists for a grenade that can be easily assembled by a player just prior to starting a paintball game or during the game itself.

BRIEF SUMMARY OF THE INVENTION

A paintball grenade. according to the present invention includes an enclosure that can be filled with water, such as a balloon. To prepare the grenade for use, a user places a thickening agent, a coloring agent, and a mixing agent in the enclosure. Typically, all three agents will be combined in the form of a single capsule or tablet. After placing the agents in the enclosure, the user adds water to the enclosure until the desired grenade size is obtained. In the preferred embodiment, the thickening agent is carboxymethylcellulose and the coloring agent is vegetable dye. Typically, the mixing agent is sodium bicarbonate.

The addition of water to the thickening agent increases the viscosity of the water, creating a gelatinous liquid having the consistency of syrup. The coloring agent colors the water so that the liquid will be easily identifiable after the grenade has ruptured. The mixing agent assists in mixing the water with the thickening agent and the coloring agent.

The user seals the enclosure after filling it with water. If a balloon is used as the enclosure, the user will typically tie a knot in the stem of the balloon to prevent the contents from escaping. After sealing the enclosure, the grenade is ready for use in a paintball game.

The user will typically throw the grenade at players of an opposing team in order to eliminate them from the game. When the grenade strikes another player or an object near another player, the grenade will rupture, thereby splattering the colored, gelatinous liquid radially outward from the point of impact. If any of the liquid marks a player, the player is required to exit the game.

Although the user will usually throw the grenade, the grenade could be propelled using a grenade launcher. A multiple person grenade launcher could be used by several members of a team to launch the grenade over great distances. A personal grenade launcher could be used by a single player to obtain greater distance than that afforded by simply throwing the grenade.

Other objects, features, and advantages of the present invention will become apparent with reference to the drawings and detailed description which follow.

DETAILED DESCRIPTION OF THE PREFERRED EMBODIMENT

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

In the method for making a paintball grenade of the present invention, those of ordinary skill in the art will appreciate that a paintball grenade is larger in size than traditional paintballs used in paintball games. Unlike traditional paintballs, which are normally fired at high speeds from compressed-air guns, paintball grenades are generally thrown by hand or launched from low-speed launching devices. Because paintballs are fired at high velocities, the paintball shells must be sufficiently rigid so as to not overly deform during flight, which deformation would alter the aerodynamic characteristics of the paintball thereby causing inaccuracies. Moreover, the paintball enclosures must be sufficiently strong so as to not burst during firing.

Paintball grenades, however, do not generally experience the forces associated with accelerating the grenade to a high velocity. Instead, grenades are hand-thrown or are launched from relatively low-velocity launchers. Therefore, paintball grenades do not require the same type of semi-rigid enclosure associated with traditional paintballs. The preferred embodiment of the present invention recognizes this fact and presents a low-cost method for making a paintball grenade.

Figure 1:
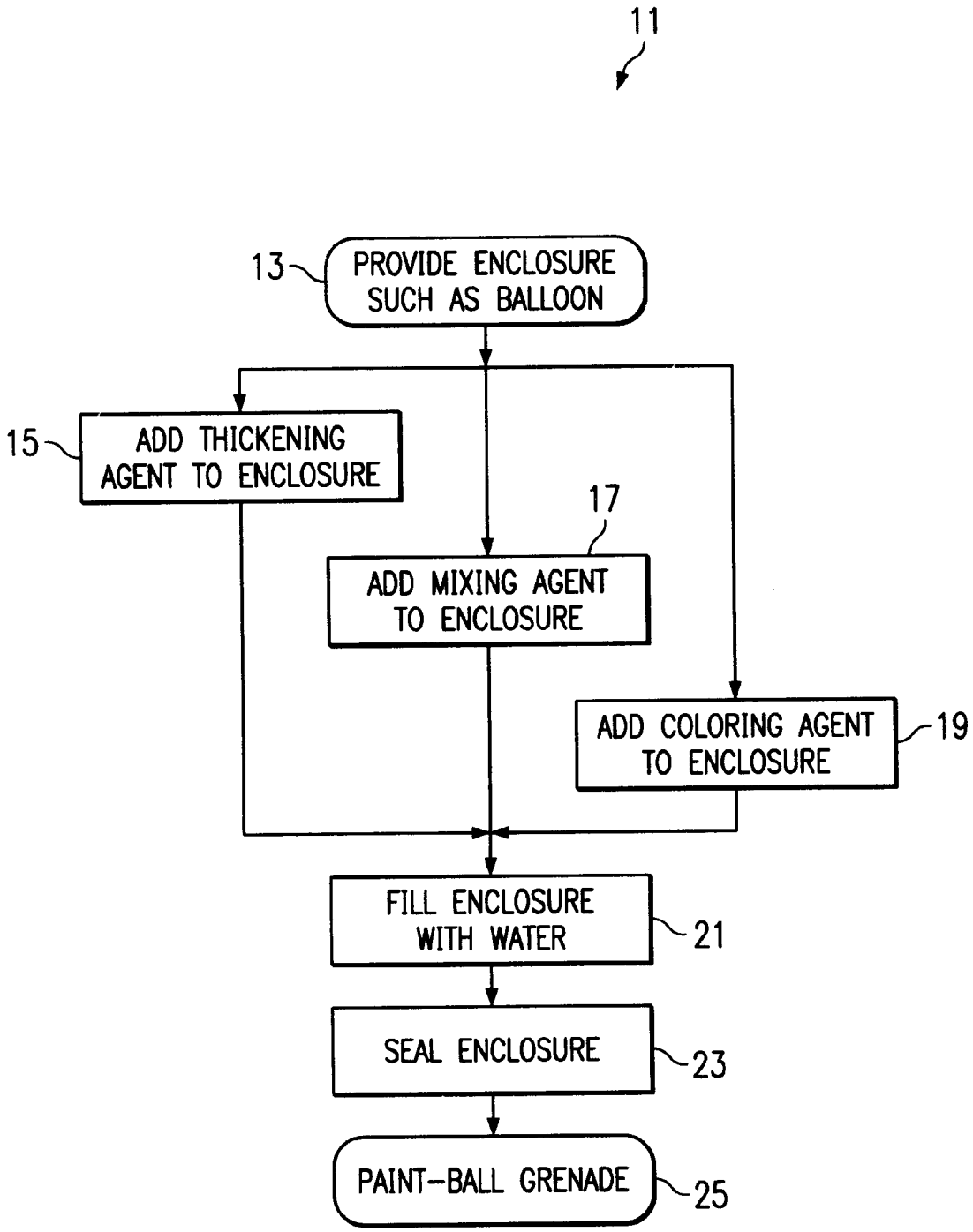
FIG. 1 is a flow diagram illustrating a method of manufacturing a paint ball grenade according to the present invention.

Referring to FIG. 1, a method for manufacturing a paintball grenade is illustrated in a flow chart 11. At an initial step 13, the user obtains an enclosure for containing the "paint" of the paintball grenade. As is described in detail below, the "paint" is not actually paint but a gelatinous liquid that is preferably non-toxic, washable, and biodegradable. The enclosure referred to at step 13 is preferably a common latex or rubber balloon; however, any pliable material, such as a plastic bag, could be used. The balloons can be of the type typically associated with children's toys. Preferably, the balloons should be generally spherical in shape to maximize the ease with which the balloon is handled, but it is conceivable that variously shaped balloons could be used to approximate the appearance of a real grenade.

Those of ordinary skill in the art will appreciate that a paintball grenade should contain a fluid having a consistency thicker than that of water. Indeed, a gelatinous liquid is desirable with a viscosity similar to that of household syrup. Referring again to FIG. 1, step 15 provides for the addition of a thickening agent to the enclosure. The thickening agent will later be mixed with water to create the gelatinous liquid. Preferably, the thickening agent is carboxymethylcellulose (CMC). CMC is a thickening and emulsifying agent that can be added to water to make the resulting liquid more viscous. The thickening process occurs as the CMC absorbs a portion of the water. When the thickening agent is mixed with water in the enclosure, the desired gelatinous material is formed. Those skilled in the art will understand that other ingredients could be substituted for CMC. For example, gum tragacanth, corn starch, or psyllium hydrophilic mucilloid could also be used. All of these material also cause water to become more viscous during an absorption process. CMC is preferred, however, because it is produces the most consistent gelatinous liquid. It is also relatively inexpensive and is non-toxic, hypo-allergenic, and biodegradable. The exact amount of CMC used to thicken a given quantity of water could vary widely, however, an acceptable ratio is approximately 2 grams of CMC for every 10 ounces of water.

In step 17, a mixing agent is added to the enclosure. The mixing agent, which is preferentially sodium bicarbonate, is used to assist the absorption and thickening of the water by the thickening agent. Those skilled in the art will appreciate that sodium bicarbonate reacts with water to cause the production of numerous gas bubbles that agitate the water and cause it to move about within the enclosure. That movement of water assists in bringing water in contact with the particles of the thickening agent, allowing the thickening agent to more quickly absorb the water. In addition, the mixing agent assists in the dispersion of the coloring agent added at step 19 as described below. While it is preferable to include the mixing agent, it is not essential to the present invention. The thickening agent will absorb the water to create the paintball grenade without the use of the mixing agent, although the absorption will take a longer period of time. In lieu of the mixing agent, the mixing process could be accomplished by external agitation of the enclosure, such as by shaking the grenade after adding water to the thickening agent.

In step 19, a coloring agent is added to the enclosure. As one function of the paintball grenade is to identify that persons or objects have been hit by spray from a ruptured grenade, it is preferable to include a coloring agent of a particular color within each paintball grenade. While the particular colors are not important to the invention, for practical reasons, it is anticipated that different colors of coloring agents will be available so that the various teams in a paintball game can each have a specific color of paintball grenades. It should also be noted that the coloring agent could be added to the enclosure without adding a thickening agent. This would result in a less viscous, colored liquid inside the enclosure.

As the paintball grenades are designed for being directed at persons, it is desirable that the coloring agent be of a type that is easily washable from clothing and skin. It is also desirable for the coloring agent to be non-toxic. In the preferred embodiment, vegetable dye such as food coloring is used as the coloring agent. Vegetable dye is the preferred choice because it is non-toxic and provides a very concentrated source of color for the gelatinous liquid. A very small amount of vegetable dye added to the liquid in each balloon is sufficient to adequately mark players when they are hit by the paint. Those persons skilled in the art will readily appreciate that other dyes or colored chalk would provide a suitable substitution.

At step 21, the balloon or other similar enclosure is partially filled with water. The amount of water will vary according to the size of the desired grenade. The water will be inserted into the enclosure through an opening in a portion of the enclosure. Preferably, sufficient water will be put in the enclosure to expand the enclosure to a diameter of approximately 2.5 to 5 inches. The method of adding water to the enclosure will vary depending on the nature of the person adding the water. It is envisioned that the grenades normally will be assembled by a player just before or during a paintball game. However, the grenades could be pre-assembled by the manufacturer and distributed to players in their operational configuration.

When assembled by a player, the water may be added to the enclosure from a standard water faucet or garden hose connected to a water supply. Those skilled in the art will appreciate that when the enclosure is a standard balloon, the opening of the balloon may be stretched to encompass the faucet orifice. When so positioned, the player may open one or more of the faucet valves to permit flow of water into the balloon. When the balloon has been filled with the desired amount of water, the player may then close the faucet valve(s) to stop the flow into the balloon. Pinching the neck of the balloon between the fingers or with a clamp, the player may remove the balloon opening from around the faucet orifice without water escaping from the balloon.

In the preferred embodiment of the present invention, the steps of adding the thickening agent 15, adding the mixing agent 17, and adding the coloring agent 19 take place before water is added to the enclosure. A preferred method of adding these ingredients would be to drop a single capsule or tablet in an orifice of the enclosure, the single capsule or tablet containing a combination of all three ingredients. Because the grenades are to be directed toward persons and used in outdoor environments, it is desirable that all of the ingredients used within the grenades be non-toxic, biodegradable, water soluble, and hypoallergenic.

An alternative method of adding the ingredients of steps 15, 17, and 19, is to add the ingredients after the balloon has been filled with water. A tablet or capsule containing the three agents may be introduced into the water-filled balloon by first inserting a tube through the balloon opening and into the neck of the balloon. With the tube so positioned in a vertical or inclined orientation, the tablet or capsule may be inserted into the tube, whereby the tablet or capsule slides through the tube into the water within the balloon.

Referring again to the preferred embodiment of FIG. 1, once the thickening agent, mixing agent, coloring agent, and water have been added to the enclosure, the enclosure is sealed in step 23 so as to prevent leakage of the fluid from the paintball grenade. Where the enclosure is a balloon, the step of sealing the balloon is preferably performed by tying a knot in the neck of the balloon. Of course, those of ordinary skill in the art will appreciate that the enclosure can be sealed by using any traditional method such as using a clamp on the neck of the enclosure or heat-sealing the neck of the enclosure. The sealing step 23 completes the method of forming a paintball grenade 25.

Figure 2:
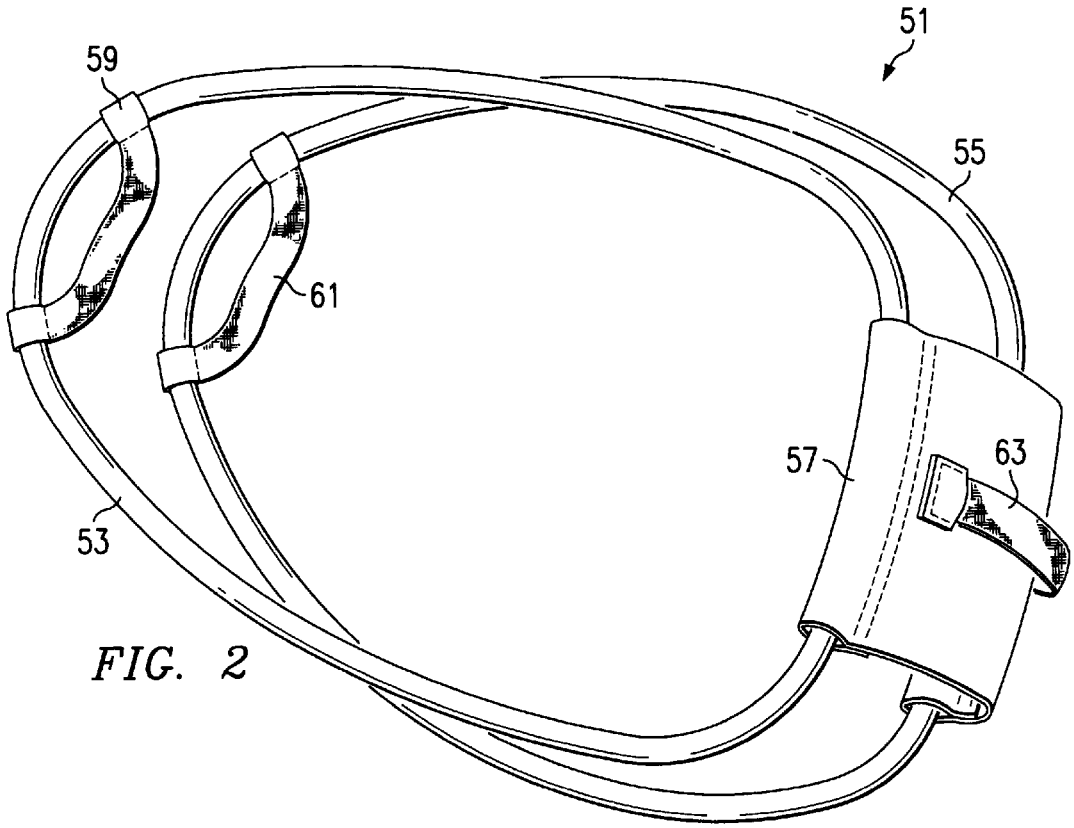
FIG. 2 is a perspective view of a multiple person grenade launcher to be used with the grenade produced by the method of FIG. 1.
Figure 3:
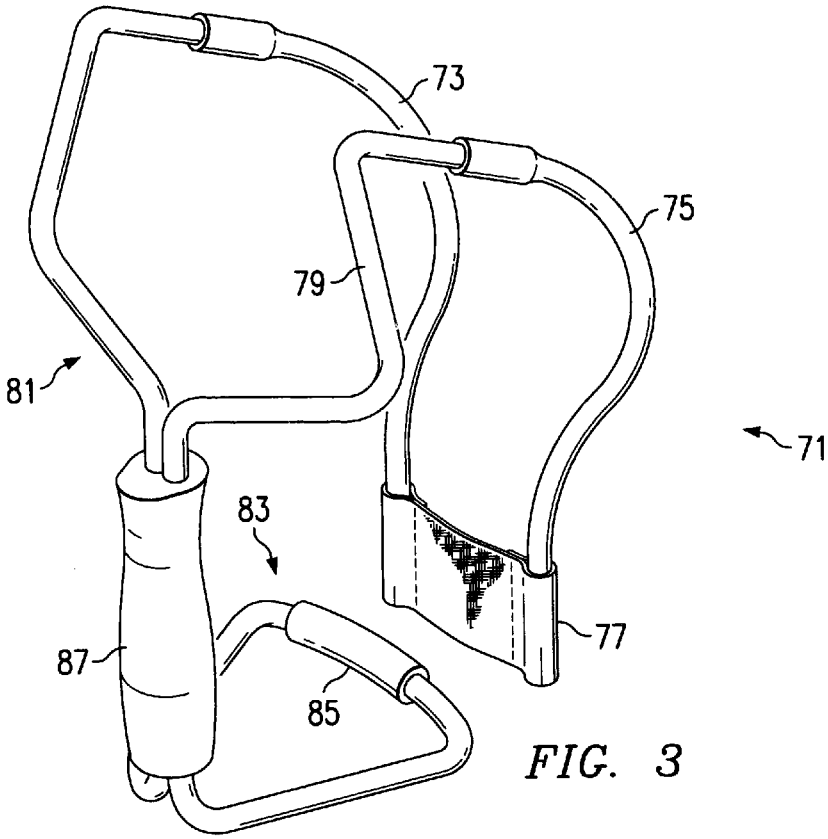
FIG. 3 is a perspective view of a personal grenade launcher to be used with the grenade produced by the method of FIG. 1.

Referring still to FIG. 1, but also to FIGS. 2 and 3, the operation of the paintball grenade 25 of the present invention is described. In operation, a player prepares grenade 25 as described in flow chart 11 (see FIG. 1) and then uses grenade 25 to eliminate opponents from the paintball game. Typically, the player propels grenade 25 at another player with sufficient force to cause grenade 25 to burst upon impact with any object. Grenade 25 may impact the player or it may impact the ground, a tree, or another object near the player. Upon impact, the enclosure portion of grenade 25 should rupture, thereby spilling or splattering the contents of the enclosure on players near the area of impact.

A player can propel grenade 25 by throwing the grenade 25 by hand or by launching the grenade 25 with a multiple-person grenade launcher 51 (see FIG. 2). Grenade launcher 51 includes a pair of launching cords 53, 55 made of conventional surgical tubing. Launching cords 53, 55 are formed into a loop shape with each launching cord 53, 55 attached to a pouch 57. Launching cord 53 includes a handle 59 for gripping by a hand of a first player in a paintball game. Launching cord 55 includes a handle 61 for gripping by a hand of a second player in the game. Pouch 57 includes a strap 63 for gripping by a hand of a third player in the game. While the first player and the second player hold handles 59, 61 stationary, the third player places paintball grenade 25 in pouch 57 such that the grenade 25 is on a side of pouch 57 opposite strap 63. The third player then applies a force to strap 63 directed away from handles 59, 61. This force causes launching cords 53, 55 to elastically stretch. When the third player releases pouch 57, the energy stored in launching cords 53, 55 is transferred to grenade 25, propelling grenade 25 toward the third player's intended target.

Referring more specifically to FIG. 3, a personal grenade launcher 71 is illustrated. Similar in design to grenade launcher 51, grenade launcher 71 includes launching cords 73, 75. Launching cords 73, 75 are attached at one end to a pouch 77 and at a second end to a frame 79. Frame 79 forms a wye 81 at one end and a wrist support loop 83 at an opposite end. A wrist pad 85 is disposed on wrist support loop 83. A handle 87 is located on frame 79 between wye 81 and wrist support loop 83. A single player can use grenade launcher 71 to propel a paintball grenade 25 at other players. The player places his hand through wrist support loop 83 and grips handle 87. Wrist pad 85 rests on top of the player's wrist. Grenade 25 is placed in pouch 77, and the player exerts a force on pouch 77 directed away from wye 81, thereby stretching the launching cords 73, 75. When the player releases pouch 77, the energy stored in launching cords 73, 75 is transferred to grenade 25, propelling grenade 25 toward the player's intended target.

Although in the preferred embodiment, the enclosure ruptures upon impact, it is conceivable that the enclosure could be designed to rupture prior to impact by forces originating within the enclosure. One method of accomplishing this would be to add an expansion agent to the water within the enclosure just before sealing the enclosure. A chemical reaction between the expansion agent. and the water or the other agents would cause the contents within the enclosure to expand until the enclosure ruptured. One suitable expansion agent would be sodium bicarbonate, the same ingredient used as a mixing agent. The reaction of sodium bicarbonate with water causes a production of carbon dioxide gas. If a suitable amount of sodium bicarbonate was added to the enclosure before sealing, the gas might be used to expand the enclosure beyond its yield point, thereby causing the enclosure to rupture.

The primary advantage of the present invention is that it provides a paintball grenade for use in paintball games that is relatively simple and inexpensive to manufacture. Another advantage is that the grenade is easily transportable from the manufacturer to the end-user. Still another advantage of the present invention is that the grenade is easily transportable by the paintball player and can be easily assembled by the player just prior to or during a paintball game. Still another advantage is that the materials used in construction of the grenade are water soluble, biodegradable, non-toxic, and hypoallergenic.

It should be apparent from the foregoing that an invention having significant advantages has been provided. While the invention is shown in only one of its forms, it is not just limited but is susceptible to various changes and modifications without departing from the spirit thereof.

I claim:

1. A method for forming a paintball grenade comprising the steps of:

(a) providing an enclosure;

(b) adding a thickening agent to the enclosure;

(c) filling at least a portion of the enclosure with water, whereby the water combines with the thickening agent in the enclosure to form a gelatinous liquid;

(d) adding a coloring agent to the enclosure; and (e) adding a mixing agent to the enclosure.

2. The method according to claim 1 wherein the thickening agent is carboxymethylcellulose, the coloring agent is vegetable dye, and the mixing agent is sodium bicarbonate.

3. A method for forming a paintball grenade comprising the steps of:

(a) providing an enclosure;

(b) adding a thickening agent to the enclosure;

(c) adding a coloring agent to the enclosure;

(d) filling at least a portion of the enclosure with water, whereby the thickening agent combines with the water in the enclosure to form a gelatinous liquid; and (e) wherein the steps (b) and (c) are performed by adding a single capsule to the enclosure, the capsule containing both the thickening agent and the coloring agent.

4. A method for forming a paintball grenade comprising the steps of:

(a) providing an enclosure;

(b) adding a thickening agent to the enclosure;

(c) adding a coloring agent to the enclosure;

(d) filling at least a portion of the enclosure with water, whereby the thickening agent combines with the water in the enclosure to form a gelatinous liquid; and (e) wherein the steps (b) and (c) are performed by adding a single tablet to the enclosure, the tablet containing both the thickening agent and the coloring agent.

5. A paintball grenade comprising:

an enclosure;

a thickening agent, whereby the thickening agent is mixed with water to form a gelatinous liquid within the enclosure;

a coloring agent; and a mixing agent, wherein the coloring agent and the mixing agent are mixed with the water and the thickening agent.

6. The paintball grenade according to claim 5 wherein the thickening agent is carboxymethylcellulose, the coloring agent is vegetable dye, and the mixing agent is sodium bicarbonate.

7. A paintball grenade comprising:

an enclosure;

a thickening agent, whereby the thickening agent is mixed with water to form a gelatinous liquid within the enclosure; and a coloring agent, wherein the coloring agent and the thickening agent are combined in the form of a capsule, and wherein the capsule and the water are added to the enclosure to form the gelatinous liquid.

8. A paintball grenade comprising:

an enclosure;

a thickening agent, whereby the thickening agent is mixed with water to form a gelatinous liquid within the enclosure; and a coloring agent, wherein the coloring agent and the thickening agent are combined in the form of a tablet, and wherein the tablet and the water are added to the enclosure to form the gelatinous liquid.

9. A paintball grenade system comprising:

a grenade launcher;

an enclosure;

a thickening agent, whereby the thickening agent is mixed with water to form a gelatinous liquid within the enclosure;

a coloring agent; and a mixing agent, wherein the coloring agent and the mixing agent are mixed with the water and the thickening agent.

10. The paintball grenade system according to claim 9 wherein the thickening agent is carboxymethylcellulose, the coloring agent is vegetable dye, and the mixing agent is sodium bicarbonate.

11. A paintball grenade system comprising:

a grenade launcher;

an enclosure;

a thickening agent, whereby the thickening agent is mixed with water to form a gelatinous liquid within the enclosure; and a coloring agent, wherein the coloring agent and the thickening agent are combined in the form of a capsule, and wherein the capsule and the water are added to the enclosure to form the gelatinous liquid.

12. A paintball grenade system comprising:

a grenade launcher;

an enclosure;

a thickening agent, whereby the thickening agent is mixed with water to form a gelatinous liquid within the enclosure; and a coloring agent, wherein the coloring agent and the thickening agent are combined in the form of a tablet, and wherein the tablet and the water are added to the enclosure to form the gelatinous liquid.

* * * * *